US007670670B2

(12) United States Patent
Stupfel

(10) Patent No.: US 7,670,670 B2
(45) Date of Patent: Mar. 2, 2010

(54) SURFACE-COVERING SYSTEM AND METHODS FOR MAKING AND USING THE SAME

(76) Inventor: Clifford M. Stupfel, 615 11th Ave. West, Kirkland, WA (US) 98033-4832

( * ) Notice: Subject to any disclaimer, the term of this patent is extended or adjusted under 35 U.S.C. 154(b) by 0 days.

(21) Appl. No.: 12/259,264

(22) Filed: Oct. 27, 2008

(65) Prior Publication Data

US 2009/0053473 A1 Feb. 26, 2009

Related U.S. Application Data

(63) Continuation of application No. 10/430,687, filed on May 5, 2003, now abandoned.

(60) Provisional application No. 60/380,047, filed on May 5, 2002.

(51) Int. Cl.
*B32B 3/02* (2006.01)
*A47B 13/08* (2006.01)
*A47B 96/18* (2006.01)

(52) U.S. Cl. ..... 428/157; 428/49; 428/78; 428/172; 428/192; 312/140.3; 312/140.4; 52/782.2

(58) Field of Classification Search ..... 428/49, 428/77, 78, 172, 192, 130, 157; 312/140.3, 312/140.4; 52/782.2; 108/27
See application file for complete search history.

(56) References Cited

U.S. PATENT DOCUMENTS

| | | | | |
|---|---|---|---|---|
| 5,253,932 | A | 10/1993 | Nesovic | |
| 5,311,825 | A * | 5/1994 | Bonham | 108/27 |
| 6,128,793 | A * | 10/2000 | Weinstein | 4/631 |
| 6,258,190 | B1 * | 7/2001 | Sciarrino et al. | 156/71 |
| 6,378,257 | B1 | 4/2002 | Guerri | |

OTHER PUBLICATIONS

Lester, R. "NFF3509 Marble and Granite Tiling". (1997), pp. 1-76.*

* cited by examiner

*Primary Examiner*—Donald Loney
(74) *Attorney, Agent, or Firm*—Christensen O'Connor Johnson Kindness PLLC

(57) ABSTRACT

A surface-covering system and methods for making and using the same. The system includes a plurality of components each being a substantially planar portion having plurality of edges and an upper surface and an under surface. A second portion is attached to the under surface of the planar portion along a predetermined one of the edges, forming a thickened edge that has a predetermined cross-section. The plurality of components are placed edge-to-edge to cover a surface. If desired, the edges can be straight and/or the upper and lower surfaces of the components can be rectangular. Also, the cross-section of the thickened edge can be an arc of a circle. The second portion can be attached to the under surface of the planar portion by an adhesive such as an epoxy adhesive. The component can be made from a quarry material such as granite.

7 Claims, 7 Drawing Sheets

SURFACE-COVERING SYSTEM AND METHODS FOR MAKING AND USING THE SAME

CROSS-REFERENCES TO RELATED APPLICATIONS

This application is a continuation of application Ser. No. 10/430,687, filed May 5, 2003, now abandoned which claims the benefit of Provisional Application No. 60/380,047, filed May 5, 2002, the disclosures of which are hereby expressly incorporated by reference in its entirety.

TECHNICAL FIELD

The present invention relates to surface coverings, and more particularly, to a surface-covering system and methods for making and using the same.

BACKGROUND

It is well known to protect surfaces such as horizontal surfaces with materials that can withstand substantial wear. Examples are surfaces around sinks and cooking areas. This protection is also important in applications such as vertical surfaces adjoining wet areas, such as showers.

The materials can include ceramic materials or quarried materials that are shaped and placed together to form a substantially impervious surface. While it is possible to make such surfaces from a single portion of a material, such applications are necessarily custom-made and, accordingly, expensive, because of the time required to make them. In many cases, it is more economical to cover surfaces with substantially identical tiles. These tiles are either abutted against one another, or placed close to one another and the gaps between filled with a grout material that renders the surface substantially impervious. Where necessary to fit the tiles, the tiles are individually cut, placed and grouted.

In construction, such surfaces are first defined by structural components, such as plywood, to support the surface. The protective surface is then formed over the structural components and glued to the structural components.

In most modern-day applications, the finish of the installed surface is all-important. Unless the surface is expensively custom-made, the facing of the surface, i.e., the portion of the surface that faces outward, must be applied separately from the application of the major portion of the surface. For example, where the application is that of a substantially horizontal surface, the edges of the horizontal surface must be finished properly, typically by forming a vertical face that adjoins the edges of the horizontal surface.

In currently applications, the facing of a surface is created separately, generally by adhering a face piece onto the outer edge of the major portion of the surface. This process, however, requires a seam (such as a channel of grout) to be formed in the major portion of the surface. Such a process is both unsightly and subject to allowing intrusion of undesirable substances (such as water) into the surface. Furthermore, it is frequently desirable to give the facing a shape that is difficult to form by adherence to the major portion of the surface.

Accordingly, it is desirable to have a surface-covering system that is not subject to these faults.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

According to one aspect, the invention is an integral surface-covering component for covering a surface. The component includes a substantially planar portion having a plurality of edges. The planar portion has an upper surface and an under surface. The component also includes a second portion attached to the under surface of the planar portion along a first predetermined one of the edges. This forms a first thickened edge. Each point on the first thickened edge has a first predetermined cross-section in the plane perpendicular to the first thickened edge at the point.

According to another aspect, the invention is a plurality of surface-covering components as described above. The plurality of components cover a substantially planar surface. Each of the surface-covering components is adjacent at least one of the other surface-covering components along an edge other than a predetermined one of the edges.

According to another aspect, the invention is a method for making an integral surface-covering component for covering a surface. The method includes the step of a) forming a substantially planar portion from a material, where the substantially planar portion has a plurality of edges, and the planar portion has an upper surface and an under surface. The method also includes the step of b) forming a second portion from the material. The method further includes the step of c) attaching the second portion to the under surface of the planar portion along a first predetermined one of the edges, thereby forming a rough thickened edge.

According to a further aspect, the invention is an integral surface-covering component made according to the method described above.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
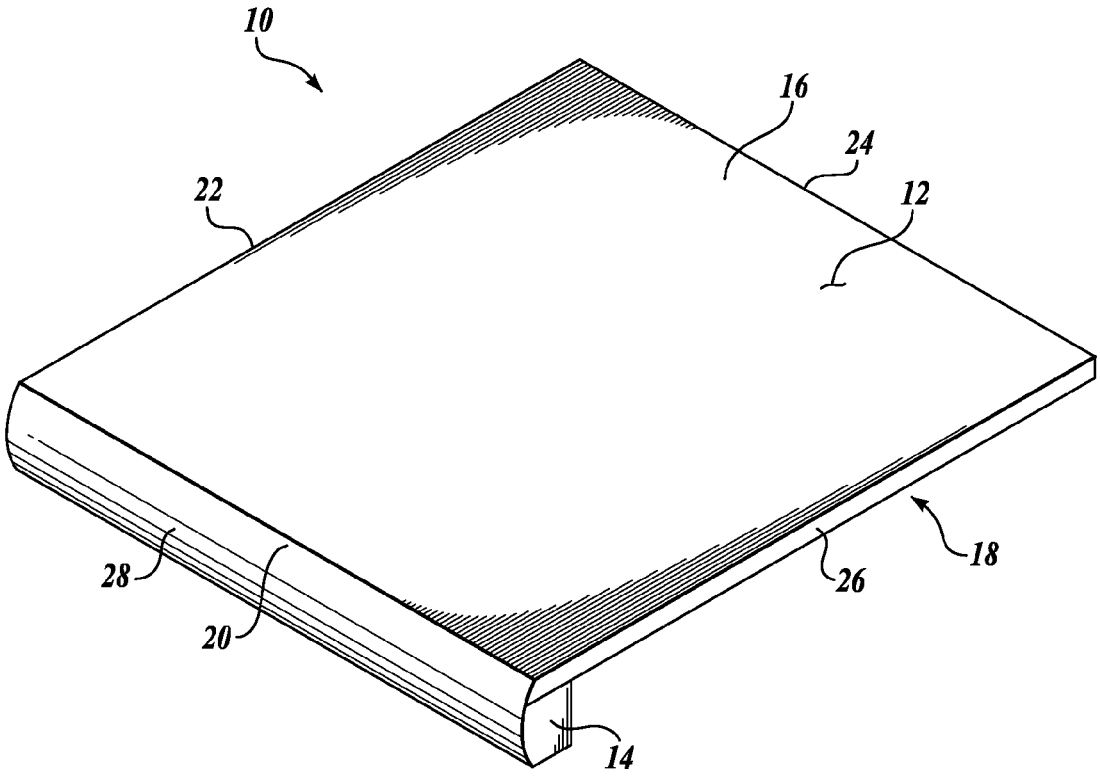
FIG. 1 is a perspective drawing of a bull nose component of the inventive system.
Figure 2:
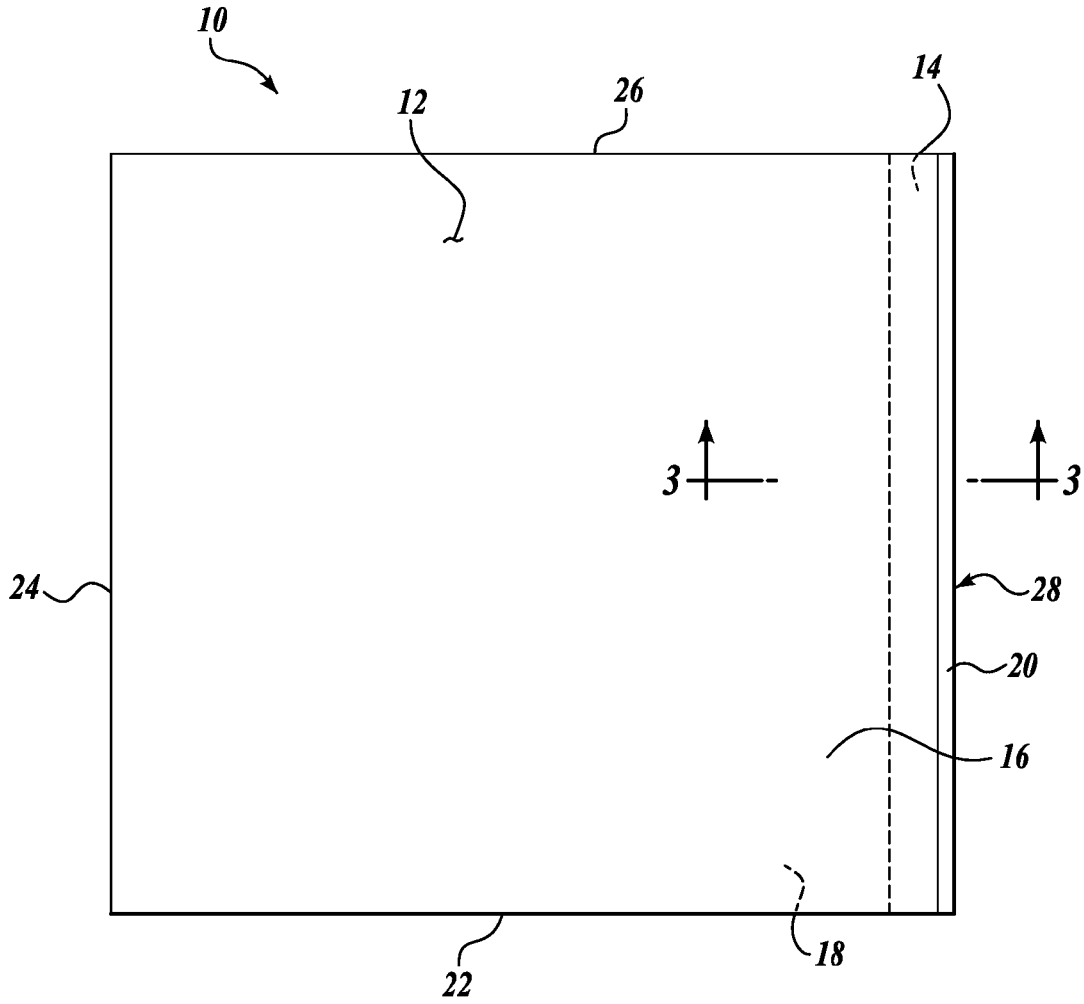
FIG. 2 is a plan view of the bull nose component shown in FIG. 1.

FIG. 1 is a perspective drawing of a bull nose component of the inventive system, and FIG. 2 is a plan view of the bull nose component shown in FIG. 1. The bull nose component 10 includes a substantially planar portion 12 and a second portion 14. The substantially planar portion 12 has an upper surface 16 and an under surface 18.

The substantially planar portion 12 also has a plurality of edges 20, 22, 24, and 26. If desired, the edges 20, 22, 24 and 26 can be beveled at a 45 degree angle, providing a very thin bevel, approximately 0.03 inch across. In general, the substantially planar portion 12 can have any number of edges, as will be understood by those skilled in the art. However, for illustrative purposes, the component 10 shown in FIG. 1 is rectangular, having four edges, which can be grouped into two pairs of parallel edges. One pair of parallel edges includes edges 20 and 24, while the other pair of parallel edges includes edges 22 and 26.

The second portion 14 is attached to the under surface 18 of the component 10, along the edge 20 of the substantially planar portion 12, forming a thickened edge 28. Each point of the thickened edge 28 can have a predetermined cross-section in the plane perpendicular to the thickened edge 28 at the point. As shown in FIG. 1, the thickened edge 28 is an arc of a circle.

The custom of the surface tiling industry is that the tiles should be ⅜ inch thick, and most common tiles are square, with sides equal to 12 inches. Accordingly, to make the components of the inventive system compatible with the currently-existing tiles, the substantially planar portion 12 of the inventive components is preferably also ⅜ inch thick and the edges 20 and 24 are 12 inches long. The purpose of the component 10 is to provide a finished look to an installed system according to the present invention. Accordingly, the dimension of the component 10 in the direction parallel to the edges 22 and 26 is 13-¼ inches, and the overall thickness of the thickened edge 28 is 1-½ inches.

The second portion 14 of the component 10 can be attached to the under surface 18 of the component 10 by means of a very thin layer of an adhesive, such as an epoxy adhesive that can be colored to blend with the color of the substantially planar portion 12 and the second portion 14. Conventional colors in the trade that are especially suitable for use with the present invention are absolute black, midnight jade, imperial sage, venito topaz, and black empress, although no limits to the colors of the components is to be inferred by any portion of this specification.

Typically the portions 12 and 14 are made from quarry material such as field granite, although they could be made from any other suitable material, including natural and synthetic materials known to those skilled in the relevant arts. In the case where the components 10 are made from synthetic materials, the portions 12 and 14 can be attached as integral pieces, i.e., they can be manufactured attached to one another.

Figure 3:
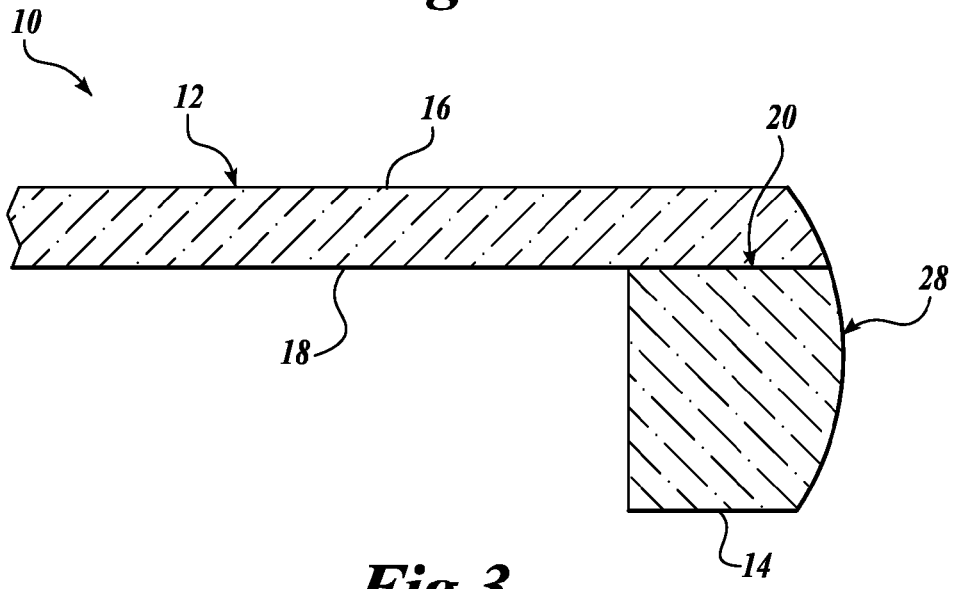
FIG. 3 is an elevation view of the components of the inventive system.

FIG. 3 is an elevation view of the components of the inventive system. For illustrative purposes, the relevant portions of the component shown in FIG. 3 is labeled as if it were a part of the component 10, taken along the cross-section A-A of FIG. 2.

Figure 4:
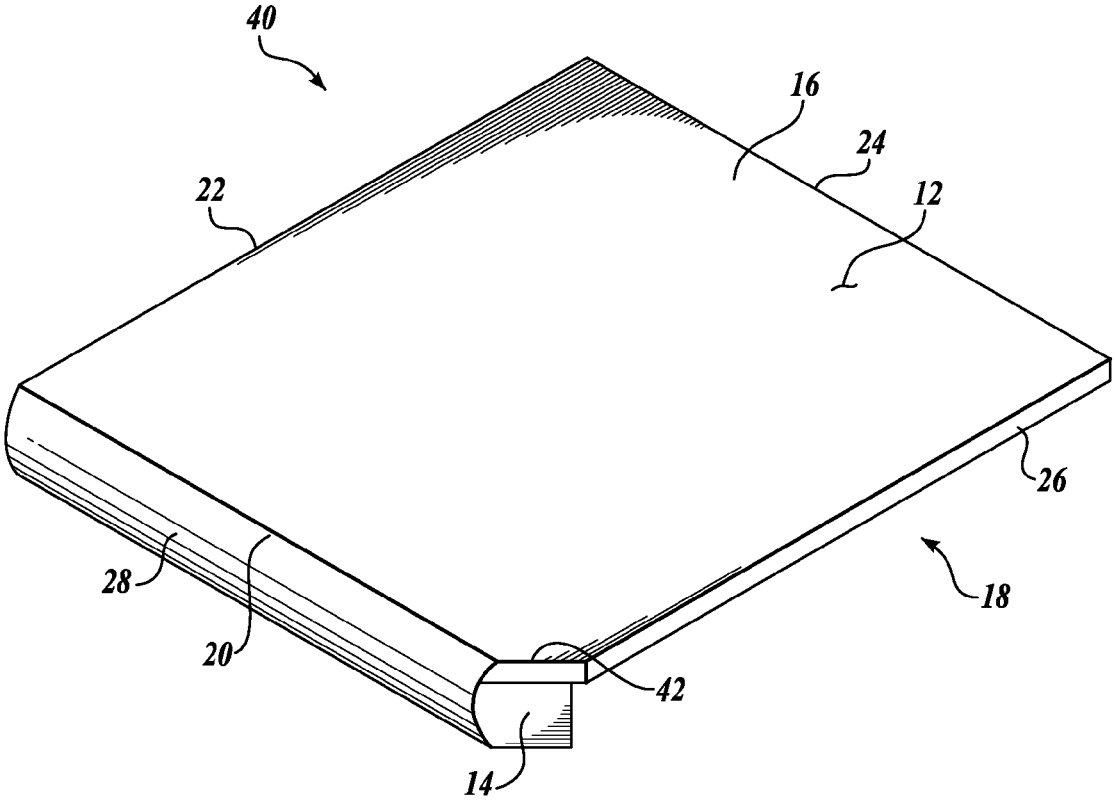
FIG. 4 is a perspective drawing of a left hand inside corner component of the inventive system.
Figure 5:
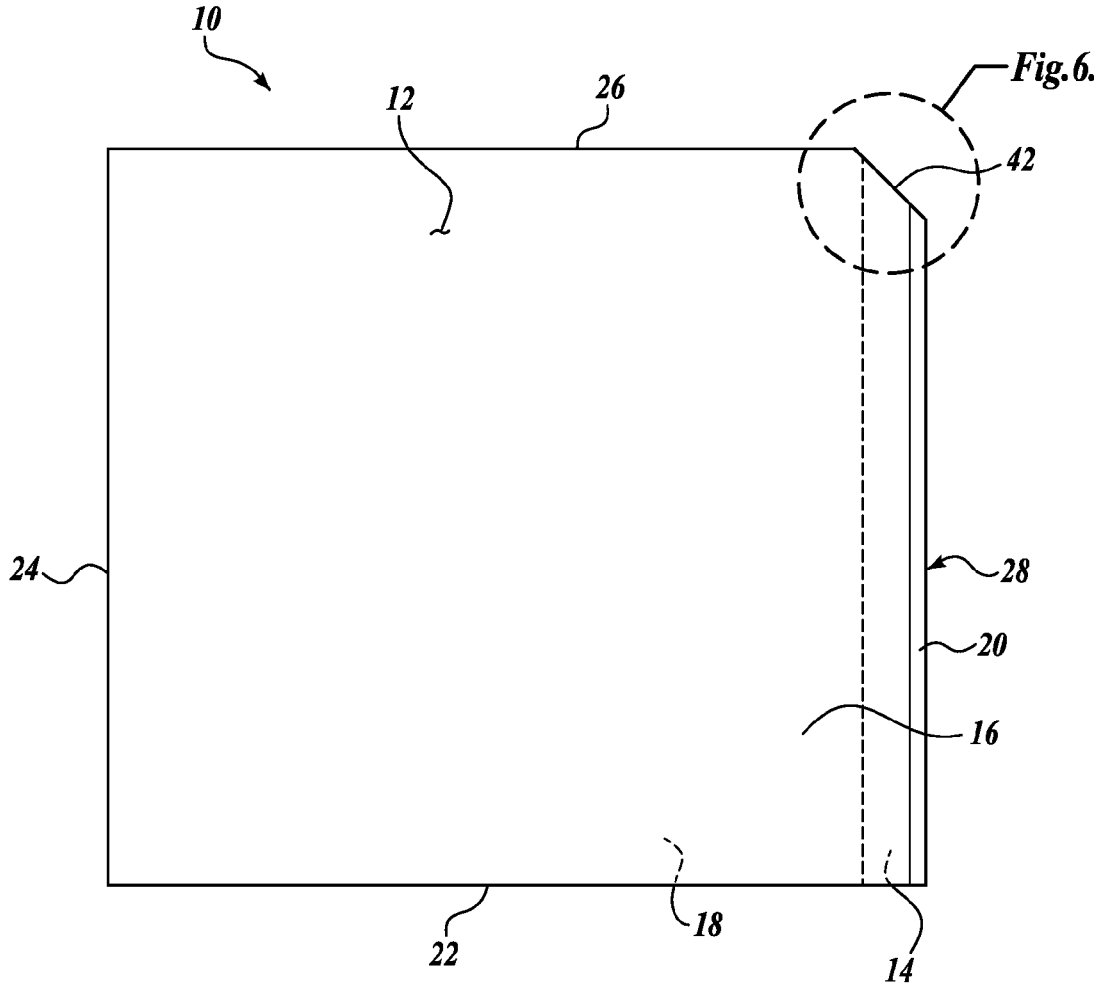
FIG. 5 is a plan view of the left hand inside corner component shown in FIG. 4.

FIG. 4 is a perspective drawing of a left hand inside corner component of the inventive system, and FIG. 5 is a plan view of the left hand inside corner component shown in FIG. 4. Where it applies, the features of the left hand inside corner component will be given the same reference numbers as were used in the description of the bull nose component 10. The component 40 includes a substantially planar portion 12 and a second portion 14. The substantially planar portion 12 has an upper surface 16 and an under surface 18.

The substantially planar portion 12 also has a plurality of edges 20, 22, 24, 26, and 42. The component 40 shown in FIG. 4 is rectangular with one mitered edge, having five edges. Four of the edges can be grouped into two pairs of parallel edges. One pair of parallel edges includes edges 20 and 24, while the other pair of parallel edges includes edges 22 and 26. The edge 42 is the mitered edge, which is adjacent the edges 20 and 26. In the presently described preferred embodiment, the edges 20 and 26 form 135 degree angles with the edge 42, although in general the edges 20 and 26 could form any desired obtuse angles with the edge 42.

The second portion 14 is attached to the under surface 18 of the component 40, along the edge 20 of the substantially planar portion 12, forming a thickened edge 28. Each point of the thickened edge 28 can have a predetermined cross-section in the plane perpendicular to the thickened edge 28 at the point. As shown in FIG. 4, the thickened edge 28 is an arc of a circle.

As described above, the second portion 14 of the component 40 can be attached to the under surface 18 of the component 40 by means of a very thin layer of an adhesive, such as an epoxy adhesive that can be colored to blend with the color of the substantially planar portion 12 and the second portion 14.

Figure 6:
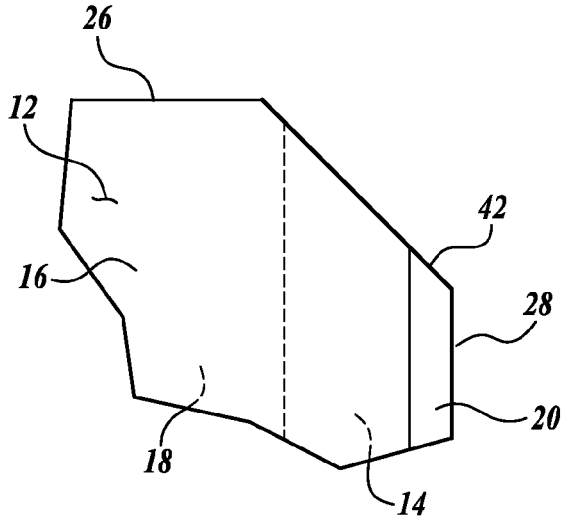
FIG. 6 is a detail view of the miter edge of the left hand inside corner component of the inventive system.

FIG. 6 is a detail view of the miter edge of the left hand inside corner component of the inventive system.

It will be understood by those skilled in the relevant arts that a right hand inside corner component could be made as described above, with the provision that the descriptions given in FIGS. 4-6 are mirror images of those needed to describe the right hand inside corner component. Accordingly, no further description of a right hand inside corner component is deemed needed.

The major dimensions of the bull nose, and left and right inside corner components are 13-¼×12 inches.

Figure 7:
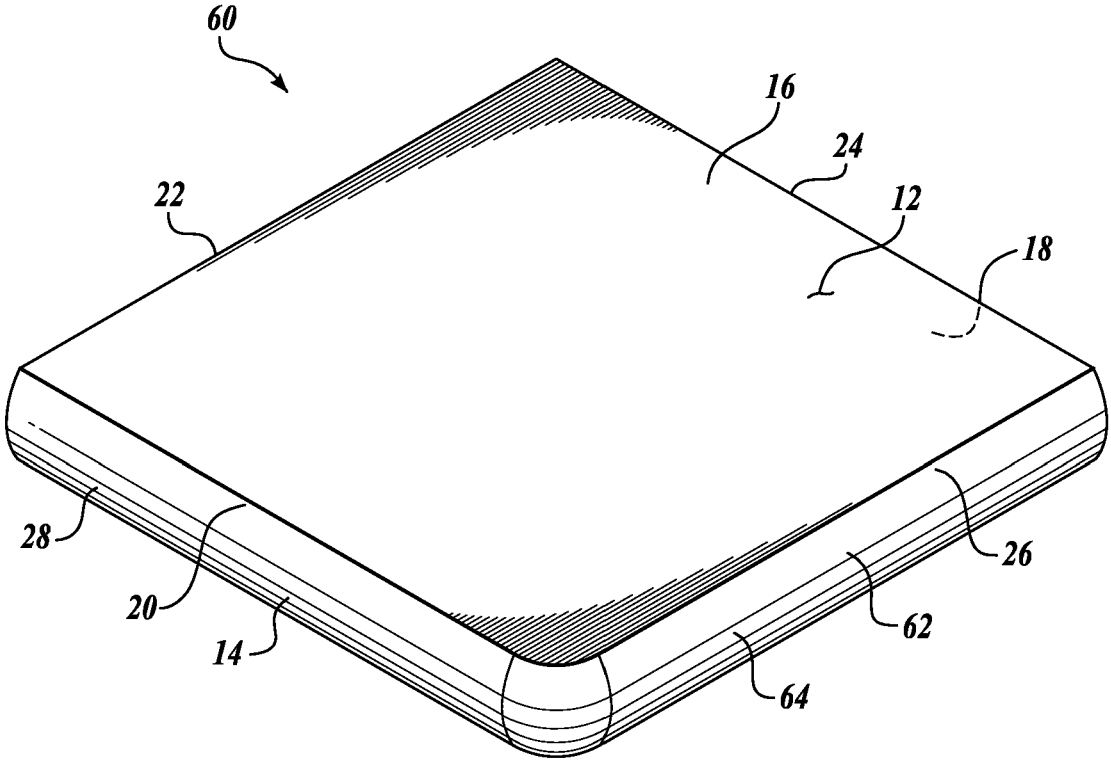
FIG. 7 is a perspective drawing of an outside corner component of the inventive system.
Figure 8:
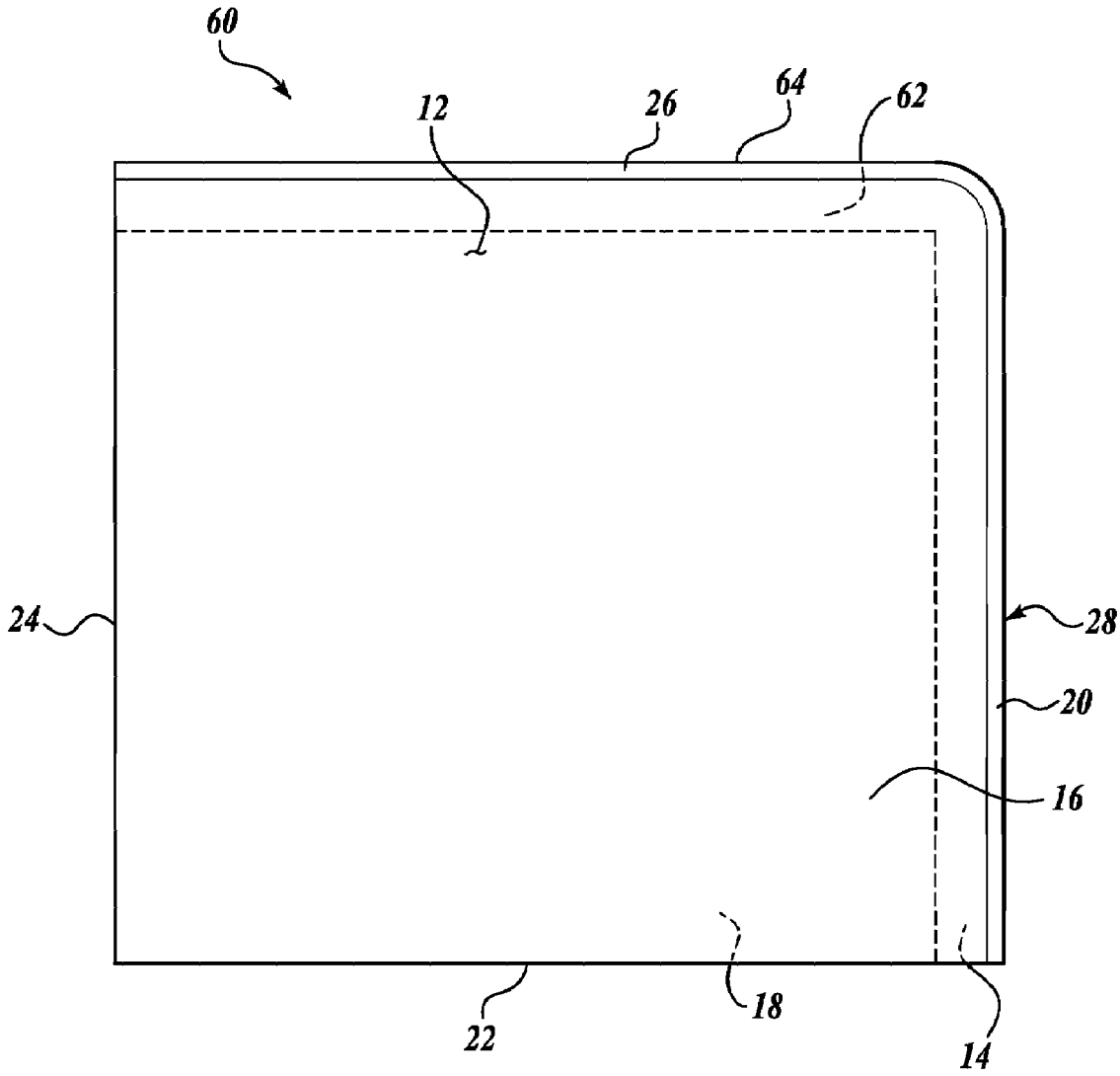
FIG. 8 is a plan view of the outside corner component shown in FIG. 7.

FIG. 7 is a perspective drawing of an outside corner component of the inventive system and FIG. 8 is a plan view of the outside corner component shown in FIG. 7. Where it applies, the features of the outside corner component will be given the same reference numbers as were used in the description of the bull nose component 10. The component 60 includes a substantially planar portion 12, a second portion 14 and another second portion 62. The substantially planar portion 12 has an upper surface 16 and an under surface 18.

The substantially planar portion 12 also has a plurality of edges 20, 22, 24, and 26. The component 60 shown in FIG. 6 is rectangular, having four edges. The four edges can be grouped into two pairs of parallel edges. One pair of parallel edges includes edges 20 and 24, while the other pair of parallel edges includes edges 22 and 26.

The second portion 14 is attached to the under surface 18 of the component 60, along the edge 20 of the substantially planar portion 12, forming a thickened edge 28. Each point of the thickened edge 28 can have a predetermined cross-section in the plane perpendicular to the thickened edge 28 at the point. As shown in FIG. 4, the thickened edge 28 is an arc of a circle.

The other second portion 62 is attached to the under surface 18 of the component 60, along the edge 26 of the substantially planar portion 12, forming a thickened edge 64. Each point of the thickened edge 64 can have a predetermined cross-section in the plane perpendicular to the thickened edge 64 at the point. As shown in FIG. 4, the thickened edge 64 is an arc of a circle.

As described above, the two second portions 14 and 62 of the component 60 can be attached to the under surface 18 of the component 60 by means of a very thin layer of an adhesive, such as an epoxy adhesive that can be colored to blend with the color of the substantially planar portion 12 and the two second portions 14 and 62.

An outside corner has major dimensions of 13-¼×13-¼ inches.

Figure 9:
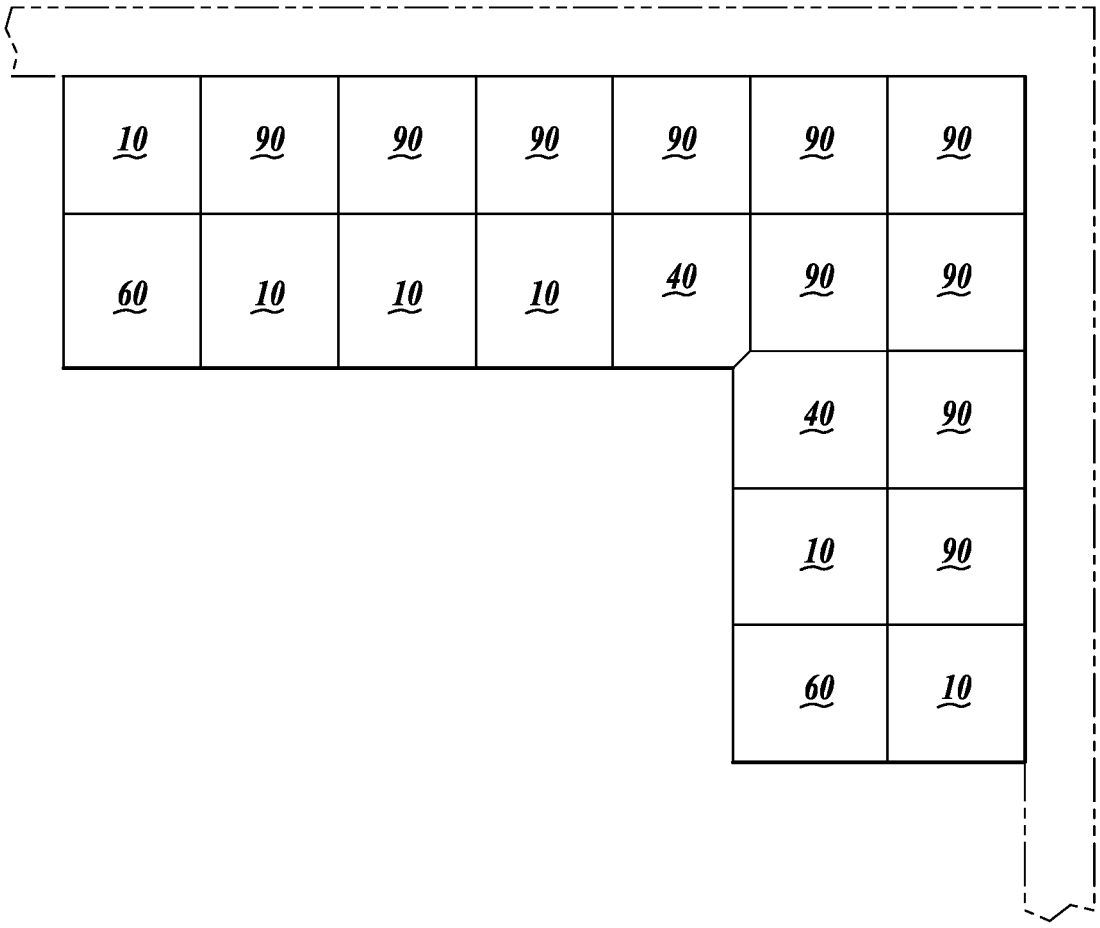
FIG. 9 is a diagram of the disclosed system in an exemplary layout of the inventive system, using the inventive components described above.

FIG. 9 is a diagram of an exemplary layout of the inventive system, using the inventive components described above. As described above, it is conventional for individual tiles to be 12 inch squares. Typically, counters are designed to be 24 inches deep and a multiple of 12 inches in the other dimensions. Thus, in the 90 degree layout shown in FIG. 9, the tiles marked with reference numbers 90 are conventional 12 by 12 inch tiles. Also, the tiles marked with reference numbers 10 are bull nose components described above, the tile marked with reference number 40 is a left hand inside corner component described above, and the tiles marked with reference numbers 60 are outside corner components described above. The tile marked with reference number 40' is a right hand inside corner component made as a mirror image of a left hand inside corner component are described above.

In addition to its application for counter tops and the like, the inventive system can be used with island counter configurations, which are conventionally 24, 36 and 48 inches in their principal dimensions. The components can also be used in raised counters, custom showers and custom tubs. Further the components can be used as surrounds for fireplaces, using rolled edge bull nose and inside corners.

In manufacturing the components of the inventive system, the second portion can be attached to the substantially planar portion by a press that uniformly applies pressure to the two portions to obtain the desired very thin layer of epoxy. Thereafter, the components can be finished to have the desired rectangular dimensions and the desired finished contour on the thickened edges. Also, the upper surface of the substantially planar portions will be polished to the desired finish.

While the foregoing is a detailed description of the preferred embodiment of the invention, there are many alternative embodiments of the invention that would occur to those skilled in the art and which are within the scope of the present invention. For example, it will be understood that the tile do not necessarily have to have rectangular shapes. Accordingly, the present invention is to be determined by the following claims.

While illustrative embodiments have been illustrated and described, it will be appreciated that various changes can be made therein without departing from the spirit and scope of the invention.

The invention claimed is:

1. An integral surface-covering system for covering a surface, comprising:

a substantially rectangular front component formed from a quarried material and consisting of a planar portion having a uniform first thickness and defining four edges, the planar portion having an under surface, and a second portion adhered to the under surface of the planar portion along one of the four edges without forming a joint on an upper surface of the front component, thereby forming a thickened edge, and wherein the thickened edge has a second thickness, and further wherein the second portion does not obscure any of the four edges of the planar portion;

a substantially rectangular outside corner component formed from a quarried material and consisting of a substantially planar portion having the uniform first thickness and defining four edges, the planar portion having an under surface, and a second portion adhered to the under surface of the planar portion along adjacent two of the four edges without forming a joint on an upper surface of the outside corner component, thereby forming first and second thickened edges having the second thickness; and an inside corner component formed from a quarried material and consisting of a planar portion having the uniform first thickness and defining four rectangularly arranged edges and a fifth edge intersecting two of the four rectangularly arranged edges at an angle of about 135 degrees, the planar portion having an under surface, and a second portion adhered to the under surface of the planar portion along one of the five edges without forming a joint on an upper surface of the inside corner component, thereby forming a thickened edge, and wherein the thickened edge has the second thickness; and a substantially rectangular planar component formed from a quarried material having the uniform first thickness;

wherein the first thickness is about ⅜ inch and the second thickness is about 1-½ inches;

and further wherein the second portions of the front component, outside corner component and inside corner component are flush with the associated edge of the corresponding planar portion.

2. The integral surface-covering system of claim 1, wherein the rectangular front components are approximately 13.25 inches long and 12 inches wide.

3. The integral surface-covering system of claim 1, wherein the planar portions of the front component and the planar portion of the outside corner component are rectangular.

4. The integral surface-covering system of claim 1, wherein the thickened edges of the front component, the first and second thickness of the outside corner component and the thickened edge of the inside corner component all have a cross-sectional shape defining an arc of a circle.

5. The integral surface-covering component of claim 1, wherein the second portion of the front component is adhered to the under surface of the planar portion by an adhesive colored to blend with the quarried material.

6. The integral surface-covering component of claim 5, wherein the adhesive is an epoxy adhesive.

7. The integral surface-covering component of claim 1, wherein at least one of the edges of the front component, at least one of the edges of the outside corner component, and at least one of the edges of the inside corner component are beveled at the upper surface.

* * * * *